United States Patent [19]

Sumitomo

[11] 4,184,542

[45] Jan. 22, 1980

[54] PLATE TYPE CONDENSER

[75] Inventor: Hiroyuki Sumitomo, Takatsuki, Japan

[73] Assignee: Hisaka Works, Ltd., Osaka, Japan

[21] Appl. No.: 836,996

[22] Filed: Sep. 27, 1977

[30] Foreign Application Priority Data

| | | | |
|---|---|---|---|
| Apr. 16, 1976 | [JP] | Japan | 51/43998 |
| Oct. 1, 1976 | [JP] | Japan | 51/118700 |
| Oct. 19, 1976 | [JP] | Japan | 51/125699 |
| Apr. 16, 1977 | [JP] | Japan | 52/43997 |

[51] Int. Cl.[2] ..... F28F 3/08

[52] U.S. Cl. ..... 165/166

[58] Field of Search ..... 165/166, 167

[56] References Cited

U.S. PATENT DOCUMENTS

| | | | |
|---|---|---|---|
| 3,792,730 | 2/1974 | Anderson | 165/167 |
| 4,063,591 | 12/1977 | Usher | 165/167 |

FOREIGN PATENT DOCUMENTS

| | | | |
|---|---|---|---|
| 964129 | 7/1964 | United Kingdom | 165/167 |

*Primary Examiner*—Sheldon Richter

*Attorney, Agent, or Firm*—Armstrong, Nikaido, Marmelstein & Kubovcik

[57] ABSTRACT

A plate type condenser comprising a plurality of heat transmitting plates which are assembled in side-by-side contacted relation and enclosed in a container or shell, with a gasket disposed between adjacent heat transmitting plates in such a manner that suitably opened steam passages and closed cooling liquid passages are alternately defined in the internal clearances of the plate assembly. The plate type condenser is constructed to improve the heat transmitting performance in that the pressure loss of steam at the steam inlet opening in the side-by-side contacted plates is reduced and the gaskets for preventing leakage of cooling liquid are fixed; that short pass between the plates and the shell is prevented to limit the flow of steam to a given direction; and that the influences of uncondensable gases contained in the steam on the heat transmitting performance of the condenser are minimized with due consideration given thereto.

2 Claims, 14 Drawing Figures

PLATE TYPE CONDENSER

BACKGROUND OF THE INVENTION

The present invention relates to plate type condenser and more particularly it relates to a condenser called the plate and shell type condenser wherein a plurality of heat transmitting plates which are assembled in side-by-side contacted relation are enclosed in a container.

In this type of condensers, a plurality of heat transmitting plates are in a side-by-side contacted relation within a container or shell with a gasket disposed between adjacent heat transmitting plates, the disposition of the gaskets being such that steam passages which suitably open to the space inside the shell and cooling liquid passages isolated from said space are alternately defined in the internal clearances of the plate assembly. The steam supplied from the steam supply port of the shell flows into the steam passages through the openings therein and cooled by the cooling liquid in the adjacent cooling liquid passages through the heat transmitting plates and thereby condensed, the resulting condensate and uncondensed steam flowing out of the final steam passage through the steam outlet opening into the shell for discharge through the steam discharge port.

It is desirable that the steam inlet to the steam passages have a large opening area so that the pressure loss of steam at said part may not increase. Further, it is necessary that the gaskets for isolating the cooling liquid passages from the space inside the shell be firmly retained so as to prevent the leakage of cooling liquid.

When steam is supplied into the shell, if there is a space between the shell and the plates, the flow of steam is divided into two streams, a normal stream which flows from the steam inlet opening via the steam passages into the steam outlet opening and then flows out of the steam discharge port of the shell and a second stream which short-passes from the steam supply port into the steam outlet port via said space between the plates and shell. Further, since the short-passed steam naturally has a higher pressure than the steam (condensate and uncondensed steam) which has passed through the steam passages, i.e., the condensing process, into the steam outlet opening, it tends to flow from the steam outlet opening back into the steam passages. As a result, the flow of steam in the steam passages is impeded and the heat transmission efficiency is greatly reduced.

Generally, steam contains uncondensable gasses, such as air, and major factors in heat transmission technology vary according to the amount of said uncondensable gases. Therefore, it is difficult or very inefficient to apply a given plate configuration to the condensation of all kinds of gases.

Further, when steam containing uncondensable gases are being condensed, as the steam flow approaches the downstream region the concentration of uncondensable gases increases with the condensation of steam and hence the heat transmission is aggravated. Therefore, in order to prevent detraction from heat transmission performance, it is necessary to take some measure to keep the concentration of uncondensable gases low throughout the heat transmission area.

SUMMARY OF THE INVENTION

In view of the problems in this type of condensers, the present invention has for its main object the provision of a superior condenser which is capable of overcoming said problems.

Another object of the invention is to provide a plate type condenser wherein the opening area of the steam inlet port is large, the pressure loss of steam is minimized, the gaskets can be firmly fixed, and there is no leakage of cooling liquid.

Another object of the invention is to provide an effective steam seal construction between the plates and the shell in a plate and shell type condenser.

Another object of the invention is to provide a plate type condenser capable of effectively condensing steam according to the amount of uncondensable gasses by using plates of a single configuration.

A further object of the invention is to provide a plate type condenser designed to collect at a predetermined place the uncondensable gases contained in steam flowing through steam passages and take them out of the condenser, thereby improving heat transmission.

Features of the construction for achieving the above objects of the invention are as follows.

A feature of the invention is that a ridge which defines the outer edge of a gasket groove in the plate margin is such that in one plate in which such ridge projects toward the steam passage side, the abutment length of the ridge is as short as possible and the abutment length of the inter-ridge region is as long as possible while in the other plate in which such ridge projects toward the cooling liquid passage side, the abutment length of the inter-ridge region is as short as possible and the abutment length of the ridge is as long as possible so that when the two plates are put together they may respectively abut against the ridge and inter-ridge region of said one plate, whereby the ridges which project toward the steam passage side are as short as possible, thus increasing the opening area of the steam inlet and reducing the pressure loss of steam at said part while the ridges which project toward the cooling liquid passage side are as long as possible so that the gasket disposed along the outer plate periphery to isolate the cooling liquid passage from the internal shell space can be firmly fixed, thereby preventing the leakage of cooling liquid.

Another feature of the invention is that in order to prevent short pass of steam between the plates and the shell, there is employed a steam seal construction making use of the labyrinth effect.

Still another feature of the invention is that the length of gaskets which define steam passages can be adjusted to the conditions of heat transmission technology on the basis of the amount of uncondensable gases, whereby the plates develop high performance in various forms of condensation without being considerably influenced by the presence of uncondensable gases.

These and other features of the invention will become more apparent from the following description of the construction of the invention when taken in conjunction with the accompanying drawings.

DESCRIPTION OF THE PREFERRED EMBODIMENTS

Figure 1:
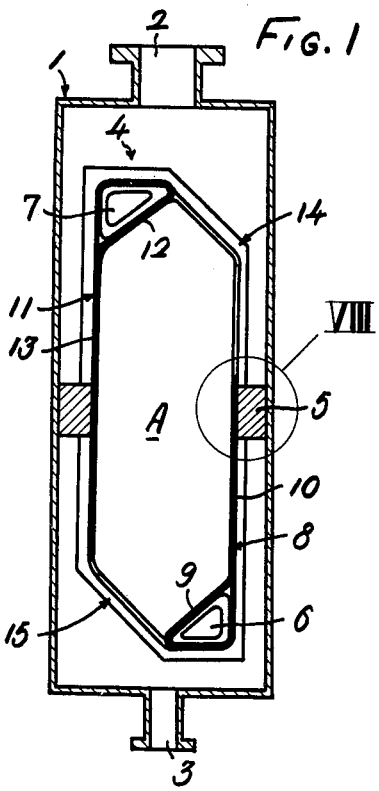
FIG. 1 is a longitudinal section schematically showing the entire arrangement of a plate type condenser according to the present invention.

Referring to FIG. 1 schematically showing the entire arrangement of a condenser according to the present invention, 1 designates a container or shell having a steam supply port 2 and a condensate exit port 3, and 4 designates a group of heat transmitting plates enclosed in the container or shell 1 in which they are suspended by seal stays 5.

Figure 2:
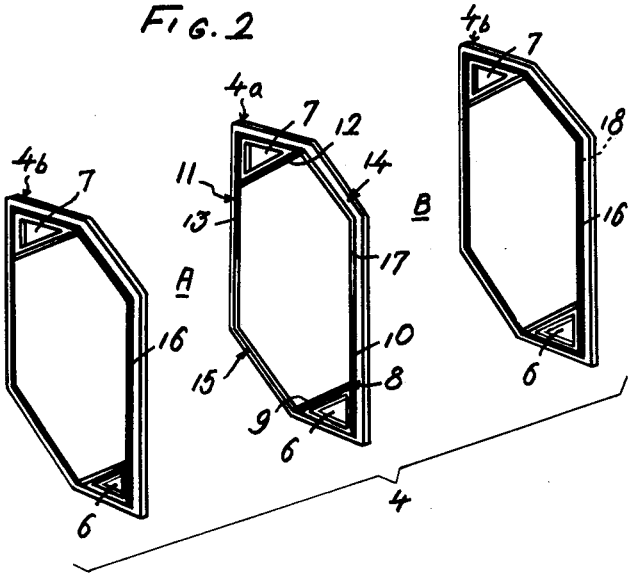
FIG. 2 is an exploded perspective view showing heat transmitting plates to be assembled in side-by-side contacted relation.

The heat transmitting plates are assembled in side-by-side contacted relation as shown in FIG. 2, and in FIG. 1 the condensation heat transmission surface of such heat transmitting plate presenting a steam passage is shown. Each heat transmitting plate has an entrance 6 and exit 7 for a cooling liquid disposed so that these entrances and exits will be respectively aligned with each other when the heat transmitting plates are assembled in side-by-side contacted relation. These heat transmitting plates are assembled in side-by-side contacted relation, with a gasket disposed between adjacent heat transmitting plates so that steam passages through which steam to be condensed flows and cooling liquid passages through which a cooling liquid for cooling steam through the heat transmitting plates flows are alternately defined.

A heat transmitting plate 4*a* has mounted thereon endless gaskets 8 and 11 comprising substantially annular portions 9 and 12 surrounding the cooling liquid entrance 6 and exit 7 and linear portions 10 and 13 extending along the longer sides of the plate. A heat transmitting plate 4*b* has mounted thereon an endless gasket 16 extending along the outer peripheral portion of the plate. When these heat transmitting plates 4*a* and 4*b* are assembled in side-by-side contacted relation, between the surface of the heat transmitting plate 4*a* on which the gasket 8 is mounted and the surface of the heat transmitting plate 4*b* opposed thereto there is defined a steam passage A which, at portions designated at 14 and 15, opens to the interior of the shell 1 and which, at the substantially annular portions 9 and 12 of the gaskets 8 and 11, is isolated from the cooling liquid entrance 6 and exit 7. Further, between the other surface of the heat transmitting plate 4*a* and the opposed surface of the heat transmitting plate 4*b* on which the gasket 16 is mounted, there is defined a cooling liquid passage B which is isolated from the interior of the shell 1 by the gasket 16 and which communicates with the cooling liquid entrance 6 and exit 7.

Steam supplied to the shell 1 through the steam supply port 2 flows into the steam passages A through the steam inlet openings 14 and when it flows down the steam passages A it is cooled by a cooling liquid flowing within adjacent cooling liquid passages B from the cooling liquid entrances 6 toward the exits 7 and condensates on the condensation and heat transmission surfaces, the resulting condensate flowing down along the condensation and heat transmission surfaces to the outlet openings 15 and being finally discharged into the outside of the condenser through the condensate discharging port 3 of the shell.

The steam passages A and cooling liquid passages B are defined by the disposition of the gaskets in the internal clearances of the plate assembly, as described above, and such gaskets are mounted in gasket grooves 17 and 18 formed in the outer peripheral portions of the plates 4*a* and 4*b* as by an adhesive. The packing grooves 17 and 18 have their outer peripheral edges defined by a number of discontinuous ridges 19 and 20, as shown in FIGS. 3 through 6. The ridges 19 and 20 are formed by recessing the outer peripheral portions of the plates 4*a* and 4*b* at gasket groove bottoms 23, 24 and inter-ridge regions 25, 26 with respect to plate base surfaces 21, 22 by press work. The ridges 19, 20 and inter-ridge regions 25, 26 serve to maintain clearances between the plates 4*a* and 4*b*. More particularly, when the plates are assembled in side-by-side contacted relation, the ridges 19 on the plates 4*a* abut against the inter-ridge regions 26 of the plate 4*b* to maintain clearances between the plates 4*a* and 4*b*.

Conventionally, the abutment lengths of the ridges 19 and inter-ridge regions 26 and the abutment lengths of the ridges 25 and inter-ridge regions 20 are respectively equal to each other and the peripheral edges of the plates present a so-called honeycomb shape. In that case, the opening area of the steam entrance is small, so that the pressure loss of steam at said part is high. Further, since the outer peripheral edge of the gasket groove in the next plate clearance is defined only by small discontinuous ridges, the fixing force on the gasket is low, so that when the gasket is compressed when the plates are assembled and clamped, it tends to be outwardly squeezed, causing the leakage of fluid.

In the present invention, the abutment length of the ridges 19 formed on the side facing toward the steam passages A of the plates 4*a*, i.e., on the outer peripheral portions of the condensation and heat transmission surfaces is represented by L1, the abutment length of the inter-ridge regions 25 flush with the groove bottom of the gasket 14 is represented by L2, while in the plates 4*b*, the ridges 20 are formed to have an abutment length L2 corresponding to that of the inter-ridge regions 25 of the plates 4*a* and the inter-ridge regions 26 are formed to have an abutment length L1 corresponding to that of the ridges 19 on the plates 4*a*. The relation between such abutment lengths, in a range allowed from the standpoint of strength and fabrication, is as follows.

$$L1 << L2.$$

Figure 4:
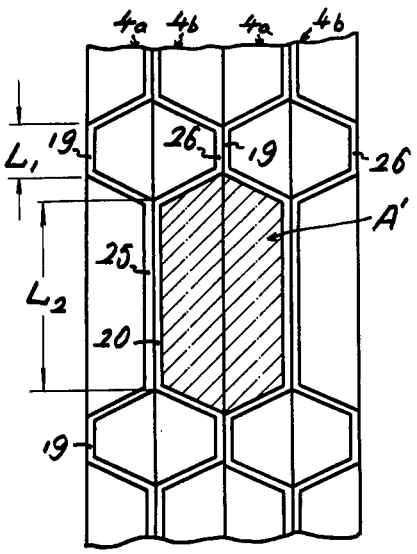
FIG. 4 is a side view taken along the line IV—IV of FIG. 3.
Figure 3:
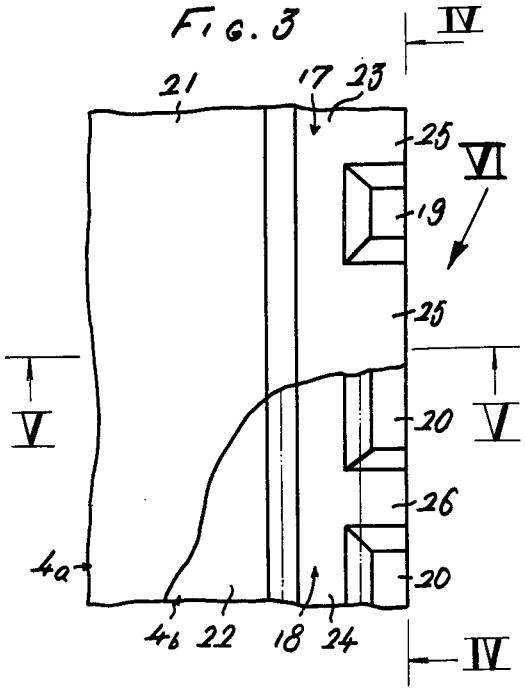
FIG. 3 is an enlarged view of the steam inlet opening in the heat transmitting plates.
Figure 5:
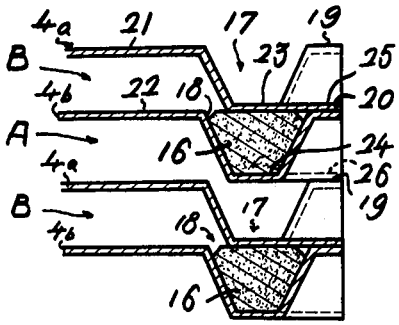
FIG. 5 is a sectional view taken along the line V—V of FIG. 3.
Figure 6:
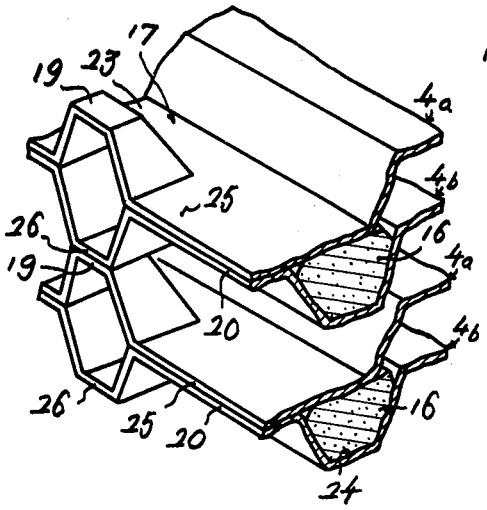
FIG. 6 is a perspective view as seen in the direction of arrow VI in FIG. 3.

As a result, in the steam passages A, the area of the steam inlet opening A′ shown by shading in FIG. 4 is maximized, thus lowering the rate of flow of steam at said part. Further, in the cooling liquid passages B, the ridges 20 forming the outer lateral wall of the gasket groove 18 are lengthwise extended to increase the fixing force on the gasket 16.

Figure 9:
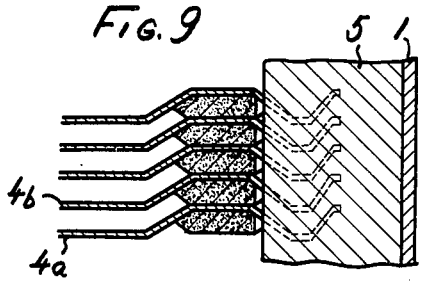
FIG. 9 is a sectional view taken along the line IX—IX of FIG. 8.
Figure 8:
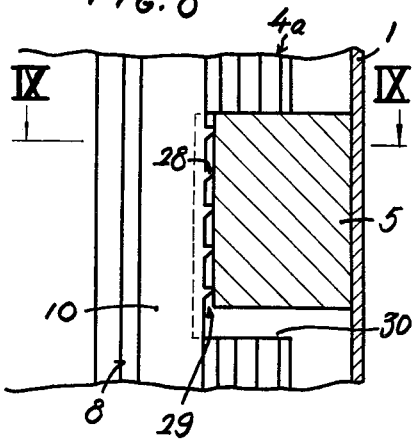
FIG. 8 is an enlarged view of a portion VIII in FIG. 1.
Figure 7:
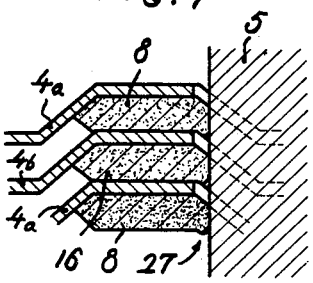
FIG. 7 is an enlarged sectional view of a seal stay portion in FIG. 1.

Referring to FIGS. 7 through 9 showing a portion of the seal stay 5 of FIG. 1 in enlarged views, a steam seal construction provided between the plates and the shell will now be described.

The seal stays 5 contact and cooperate with the linear portions of the gaskets 8 and 11 defining the steam passages and the linear portions of the gaskets 16 defining the cooling liquid passages to provide steam seals between the plates and the shell.

In FIG. 7, the gaskets 8 and 16 have a thickness suitably greater than the predetermined plate clearance so that they are compressed and squeezed when the plates 4*a* and 4*b* are clamped in assembling the condenser, thereby closing the clearances between the plates and the seal stay 5. In this way, the short pass of steam between the plates and the shell is prevented by cooperation between the gaskets 8 and 16 interposed between adjacent plates and the seal stay 5. However, the seal construction described above is insufficient in that when the gaskets 8 and 16 are squeezed, a corner 27 is more or less bent or rounded, leaving a slight clearance.

FIGS. 8 and 9 show a steam seal construction making use of the labyrinth effect to provide a securer seal. A plurality of fins 28 formed on the surfaces of gaskets 8' and 16' opposed to the seal stay 5 form a labyrinth 29 in said space, whereby the leaking steam from the above described construction flows into the labyrinth 29 where it is sealed up by the so-called labyrinth effect in which each time it flows from a narrow clearance to a wide clearance, the energy flowing at a high speed in the narrow clearance is consumed in the wide clearance so that the pressure is gradually reduced. In addition, designated at 30 is a notch formed in each plate so as to engage the seal stay 5 when the plates are enclosed in the shell.

This steam seal construction utilizing the labyrinth effect is applicable not only to other types of condensers but also widely applicable as means for sealing up steam. Further, the shape, disposition and number of fins are not limited to the illustration.

By the action of the gaskets 8 and 11 defining the steam passages A and of the steam seal means installed between the plates and the shell, the steam is given a series of directions of flow in which it flows from the steam supply port 12 successively through the steam inlet openings 14 in the steam passages A, the steam passages A and the steam outlet openings 15 and then to the condensate discharge port 3 of the shell 1.

Reference will now be made to a construction according to the invention which takes into consideration the influences of uncondensable gases contained in steam on the performance of the condenser.

Figure 10:
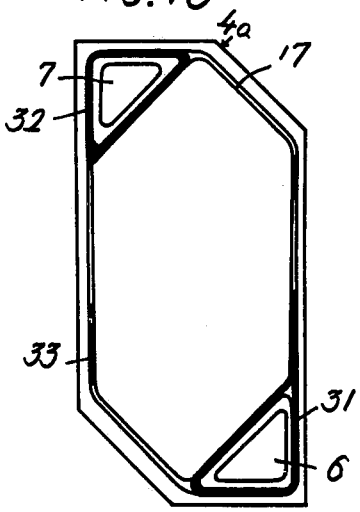
FIGS. 10 and 11 are front views showing the disposition of heat transmitting plates depending upon the amount of uncondensable gases.

FIG. 10 shows the disposition of gaskets when the amount of uncondensable gases contained in steam is small. Thus, mounted in a gasket groove 17 formed in the surface facing toward the steam passage A are substantially annular gaskets 31 and 32 for sealing up a cooling liquid around the periperies of the cooling liquid entrance 6 and exit 7 and a linear gasket 33 disposed in the lower region of a longer side of the plate 4*a* for controlling the direction of flow of steam.

When the amount of uncondensable gases is small, priority should be given to the improvement of condensation heat transmission coefficient from the standpoint of heat transmission technology, but with the arrangement described above, since the area of the steam inlet opening in the upper region of the plate is large, the rate of flow of steam at the entrance is lowered and the decrease of the amount of condensate in the middle region of the heat transmitting surface where the performance is high is prevented by the recovery of the static pressure. As a result, a high heat transmission coefficient is achieved.

Figure 11:
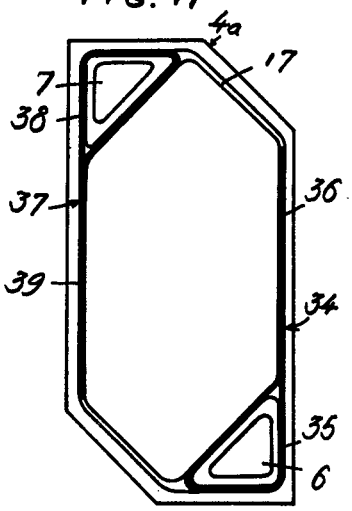

FIG. 11 shows the disposition of gaskets defining a steam passage for use when the amount of uncondensable gases is large. In this case, since what becomes a major factor is rather the rate of movement of steam from mixed steam to the heat transmitting surface than condensation heat transmission coefficient, it is necessary to employ an effective gasket disposition to increase such rate of movement.

To this end, gaskets 34 and 37 are mounted in the gasket groove 17 formed in the heat transmitting plate 4*a*, said gaskets comprising substantially annular portions 35 and 28 for sealing up a cooling liquid around the cooling liquid entrance 6 and exit 7 and long linear portions 36 and 39 disposed on the longer sides of the plate for controlling the direction of flow of steam. Therefore, the cross-sectional area of the steam passage is reduced and the rate of flow of steam is increased, so that the uncondensable gases are quickly discharged through the steam passage. As a result, interference with contact between steam and the heat transmitting surface due to the uncondensable gases staying in the steam passage is eliminated, thus allowing the steam to be effectively condensed.

Figure 12:
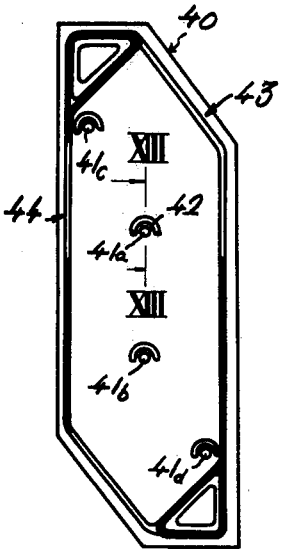
FIG. 12 is a front view of a heat transmitting plate having small vent holes for extraction of uncondensable gases.

FIG. 12 shows an embodiment of a heat transmitting plate wherein the uncondensable gases in the steam passage is collected at a place and then taken away from the condenser. The heat transmitting plate 40 is provided with small vent holes 41*a* through 41*d* for extracting uncondensable gases and a cover 42 disposed around each small vent hole. The small vent holes 41*a* are disposed at several places on the surface of the heat transmitting plate 40, and such places are located substantially on the steam entrance side and include one farthest from the steam inlet openings and those where steam tends to stagnate. For example, in the illustrated embodiment, the place where the concentration of uncondensable gases is high is the lower region of the heat transmitting plate and in order to lower the concentration of uncondensable gases there, it is necessary to extract the uncondensable gases in the upper region and moreover the steam should be prevented from being concomitantly extracted. Therefore, a small vent hole 41*a* is located at a position on the heat transmitting surface farthest from the steam entrances 43 and 44. If another small hole 41*b* is provided below said first one to supplement the same, this is more effective. A pair of small vent holes 41*c* and 41*d* are provided at upper and lower positions where steam tends to stagnate.

The reason why the small vent hole 41*a* is located in the upper region of the heat transmitting surface in the illustrated example is because steam is supplied from above the heat transmitting surface. The position where a small vent hole is located differs according to the shape of the plate. What is important is that such position is on the steam entrance side and farthest from the steam entrance, and the shape and position of the plate are not limited to the illustration.

Figure 13:
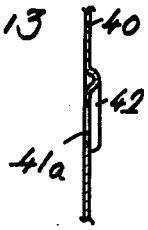
FIG. 13 is a sectional view taken along the line XIII—XIII of FIG. 12.

The cover 42, as shown in FIG. 13, is located around the small vent hole and has a semicircular shape, with the lower half open, projecting to the steam passage of the plate and it serves to prevent condensate flowing down the heat transmitting surface from entering the small vent hole. Such covers 42 may be separately produced and fixed to the plate as by welding.

Figure 14:
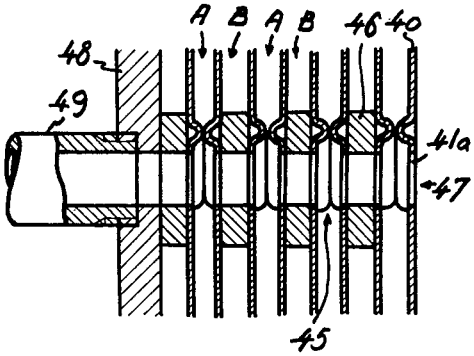
FIG. 14 is a sectional view showing a manner in which heat transmitting plates such as shown in FIG. 12 are assembled in side-by-side contacted relation.

As shown in FIG. 14, a plurality of plates of the above described construction are assembled in side-by-side contacted relation, whereby steam passages A and cooling liquid passages B are alternately formed while the small vent holes in the respective plates are aligned with each other. The covers 42 on adjacent plates abut against each other in the steam passage A to form a gas sink 45 which opens downwardly. In the cooling liquid passage B, an annular gasket 46 is disposed so as to prevent the cooling liquid from flowing into the small vent hole. In this way, a series of uncondensable gas outlet holes 47 are defined. Thus, the uncondensable gases in the steam passages A pass through an outlet pipe 49 attached to the shell to communicate with said outlet holes 47 and enter a suitable vacuum generating device (not shown) and then are discharged into the outside of the condenser.

In addition, it has been a common practice to take measures to separate condensate and uncondensable gases from each other as by utilizing a vacuum generating device interposed between the condensate discharging port of the condenser and a pump which forces condensate into the outside of the condenser. However, it has nothing to do with the heat transmission performance of the condenser, for it is nothing more than a common technique for achieving gas-liquid separation in the system downstream of the condenser and gives no consideration to the separation and removal of uncondensable gases from steam in the condensation process.

What is claimed is:

1. A plate type condenser wherein a plurality of heat transmitting plates are assembled in side-by-side contacted relation with a gasket disposed between adjacent heat transmitting plates to define therebetween suitably opened steam passages, and closed cooling liquid passages are enclosed in a shell, each of said heat transmitting plates being formed with discontinuous ridges and inter-ridge regions in its marginal portion, said ridges and inter-ridge regions contacting each other between adjacent plates to maintain a plate clearance, said condenser being characterized in that when seen from the steam passage side, said inter-ridge regions are substantially longer than said ridges.

2. A plate type condenser comprising:

a shell;

a plurality of a first type of heat transmitting plates;

a plurality of a second type of heat transmitting plate, said first type plates and said second type plates being positioned in a side-by-side contacted relationship;

gaskets disposed between adjacent heat transmitting plates to define therebetween open steam passages and closed cooling liquid passages enclosed within said shell, said first type plates formed with discontinuous ridges protruding toward said steam passages along said first type plate, and having inter-ridge regions, said regions being substantially longer than said ridges, said second type plates formed with discontinuous ridges protruding toward said cooling liquid passages along said second type plate, and having inter-ridge regions between said ridges protruding toward said cooling liquid passages which are substantially shorter than said ridges protruding toward said cooling liquid passages, said positioning of said plates being such that steam flowing in said steam passages is cooled by liquid flowing in said liquid passages adjacent said steam passages.

* * * * *